United States Patent [19]

Webb

[11] Patent Number: 5,048,365

[45] Date of Patent: Sep. 17, 1991

[54] ORDNANCE ARMING SWITCH KNOB ASSEMBLY

[75] Inventor: George Webb, Irvington, Ill.

[73] Assignee: Magnavox Government and Industrial Electronics Company, Fort Wayne, Ind.

[21] Appl. No.: 501,052

[22] Filed: Mar. 29, 1990

[51] Int. Cl.[5] ..... G05G 1/10; B25G 3/00

[52] U.S. Cl. ..... 74/553; 74/10 R; 16/121

[58] Field of Search ..... 74/553, 10 R; 16/121

[56] References Cited

U.S. PATENT DOCUMENTS

| | | | |
|---|---|---|---|
| 1,446,652 | 2/1923 | Morris | 74/553 |
| 3,198,923 | 8/1965 | Tripp | 74/553 |
| 4,131,033 | 12/1978 | Wright et al. | 74/553 |
| 4,132,129 | 1/1979 | Pratt | 74/553 |
| 4,201,096 | 5/1980 | Morrison et al. | 74/553 |
| 4,433,218 | 2/1984 | Provencher | 74/553 |
| 4,779,305 | 10/1988 | Gorsek | 74/553 |

*Primary Examiner*—Leslie A. Braun
*Assistant Examiner*—Winnie Yip
*Attorney, Agent, or Firm*—Roger M. Rickert; Richard T. Seeger

[57] ABSTRACT

An improved ordnance arming knob assembly. An arbor is secured to a switch shaft. A knob is keyed to the arbor to move in an axial direction relative to the arbor while preventing rotation between the knob and the arbor. A pin on the knob extends in a direction parallel to the switch shaft axis into a stationary hole located, for example, on a panel on which the switch is mounted. The knob must be pulled in an axial direction against the force of one or more springs to withdraw the pin from the hole prior to turning to actuate the arming switch.

10 Claims, 3 Drawing Sheets

ORDNANCE ARMING SWITCH KNOB ASSEMBLY

TECHNICAL FIELD

The invention relates to switch control knobs and more particularly to an improved ordnance arming switch knob assembly which requires two distinct actions in the proper sequence in order to arm an explosive ordnance.

BACKGROUND ART

Most ordnance arming devices used with explosives require at least two distinct enabling features to prevent accidental arming. For example, some systems require actuation of two separate switches for arming an electrically triggered explosive. In other systems, a cover must be moved to obtain access to an arming switch. In still another type of system, a key must be inserted into the switch before it can be actuated.

DISCLOSURE OF INVENTION

According to the invention, a knob assembly which requires two distinct actions is provided for arming explosive ordnance. A knob on the assembly must be pulled against a substantial spring force before it can be rotated to actuate a rotary ordnance arming switch. An arbor is secured to the shaft of a rotary switch. The knob is keyed to the arbor for limited axial movement relative to the arbor. A spring between the arbor and the knob urges the knob to an axial position wherein a pin on the knob engages a stationary hole. The hole may be, for example, in a panel on which the switch is mounted. While the pin is positioned in the hole, the knob and the arbor cannot rotate to actuate the switch. In order to actuate the switch, the knob must be pulled against the force of the spring to withdraw the pin from the hole and the knob then must be rotated to turn the arbor and the attached switch shaft.

Accordingly, it is an object of the invention to provide a switch knob assembly which requires pulling prior to rotating in order to arm an ordnance.

Other objects and advantages of the invention will be apparent from the following detailed description of preferred embodiments thereof and the accompanying drawings.

BEST MODES FOR CARRYING OUT THE INVENTION

Figure 1:
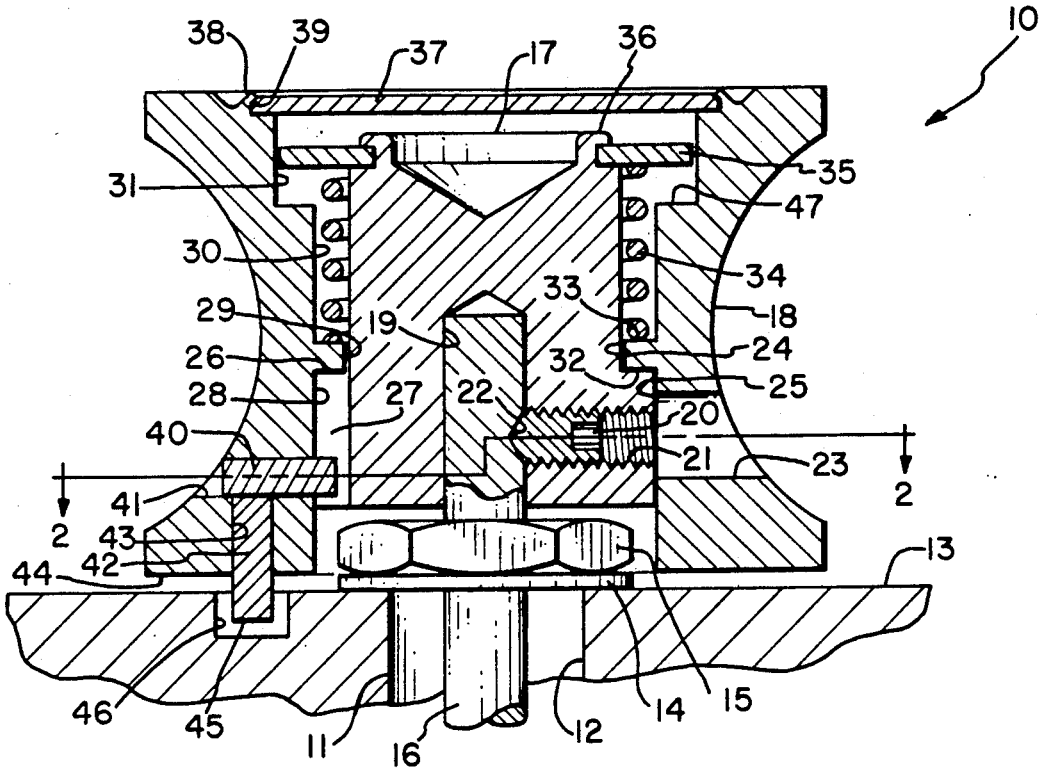
FIG. 1 is a cross sectional view through an ordnance arming switch knob assembly according to the invention and through a fragmentary portion of a switch and a panel.
Figure 2:
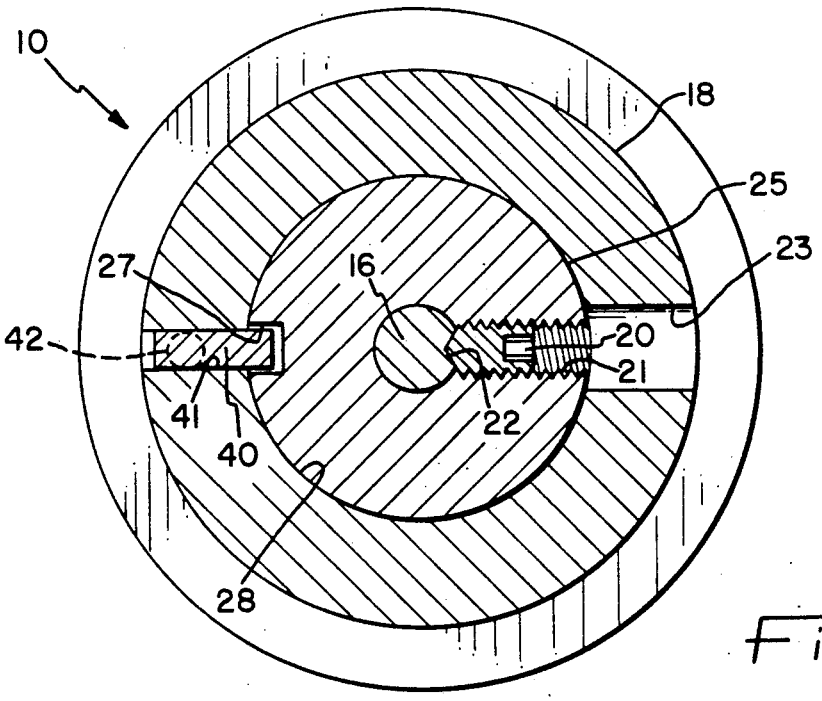
FIG. 2 is a cross sectional view taken along line 2—2 of FIG. 1.

Referring to FIGS. 1 and 2 of the drawings, a cross sectional view is shown through a knob assembly 10 according to one embodiment of the invention for actuating a rotary switch 11 (shown in fragmentary). The switch 11 is mounted in a keyed opening 12 through a panel 13. The opening 12 is keyed to prevent rotation of the switch 11 relative to the panel 13. The switch 11 is mounted on the panel 13 with a washer 14 and a nut 15. A rotary switch shaft 16 projects past the nut 15. The switch 11 may be connected, for example, to arm an explosive ordinance (not shown). Or, the switch 11 may be connected in any other electric circuit in which accidental actuation of the switch 11 must be prevented.

The knob assembly 10 generally consists of an arbor 17 and a knob 18. The arbor 17 has a blind opening 19 for receiving the shaft 16. A cone point setscrew 20 is threaded into an opening 21 in the arbor 17 and engages a conical detent 22 in the shaft 16 for securing the arbor 17 to the shaft 16. A hole 23 in the knob 18 aligns with the arbor hole 21 to facilitate insertion of the setscrew 20. The arbor 17 is generally cylindrical and has a stepped outer diameter with an upper section 24 having a slightly smaller diameter than a lower section 25. An annular surface 26 is formed between the surfaces 24 and 25. Opposite the setscrew 20, a keyway 27 is formed in the lower section 25 to extend parallel to the rotational axis of the switch shaft 16 and the attached arbor 17.

The knob 18 has a stepped axial bore including a lower section 28 which slides over the lower arbor section 25, a lower intermediate section 29 which slides on the upper arbor section 24, an upper intermediate section 30 which is coaxial with and spaced from the upper arbor section 24, and a larger diameter upper section 31. An annular surface 32 is formed between the lower bore section 28 and the lower intermediate bore section 29 and an annular surface 33 is formed between the lower intermediate bore section 29 and the upper intermediate bore section 30. A helical compression spring 34 is positioned over the upper arbor section 24 and extends between the annular knob surface 33 and a spring retainer 35 secured to the arbor 17. The spring retainer 35 may be in the form of an annular washer which is secured to the arbor 17 by bending an annular lip 36 on the arbor 17 over the spring retainer 35. After the spring retainer 35 is secured to the arbor 17 during manufacture of the knob assembly 10, a cover plate 37 is secured to the knob 18 to cover the upper knob bore section 31. The cover plate 37 is secured to the knob 18 by bending an annular lip 38 over a perimeter 39 of the cover plate 37.

A pin 40 is pressed into a radial hole 41 in the knob 18. The pin 40 projects into the keyway 27 to limit relative motion of the knob 18 to the arbor 17 to linear motion in an axial direction. During rotation of the knob 18, the pin 40 engages the sides of the keyway 27 to simultaneously rotate the arbor 17 and the attached switch shaft 16. The knob 18 has a second pin 42 pressed into a hole 43. The hole 43 is formed in a bottom surface 44 on the knob 18 and extends in a direction parallel to the axis of the switch shaft 16 and of the knob assembly 10. The pin 42 has an end 45 which projects from the bottom knob surface 44 into a hole 46 in the panel 13.

In operation, the knob 18 can move in an axial direction between two positions. In one position, as is shown in FIG. 1, the spring 34 presses the knob 18, relative to the arbor 17, towards the panel 13. At this position, movement is limited by the annular knob surface 32 abutting the annular arbor surface 26. Since the pin end 45 is located in the stationary panel hole 46, the knob 18 and the attached arbor 17 and the switch shaft 16 are prevented from being rotated. In order to actuate the switch 11, the knob 18 must be pulled in an axial direction against the force of the spring 34 to a position wherein the pin end 45 is withdrawn from the panel hole 46. While the pin end 45 is held clear of the panel hole 46, the knob 18 is rotated to actuate the switch 11. For safety, the spring 34 may be sized to require a substantial force for withdrawing the pin end 45 from the panel hole 46. For example, a pulling force on the order of 6 pounds may be required. Axial motion of the knob 18 as it is pulled away from the panel 13 is limited by the spring retainer 35 abutting an annular surface 47 between the upper intermediate bore section 30 and the upper bore section 31 in the knob 18.

Figure 3:
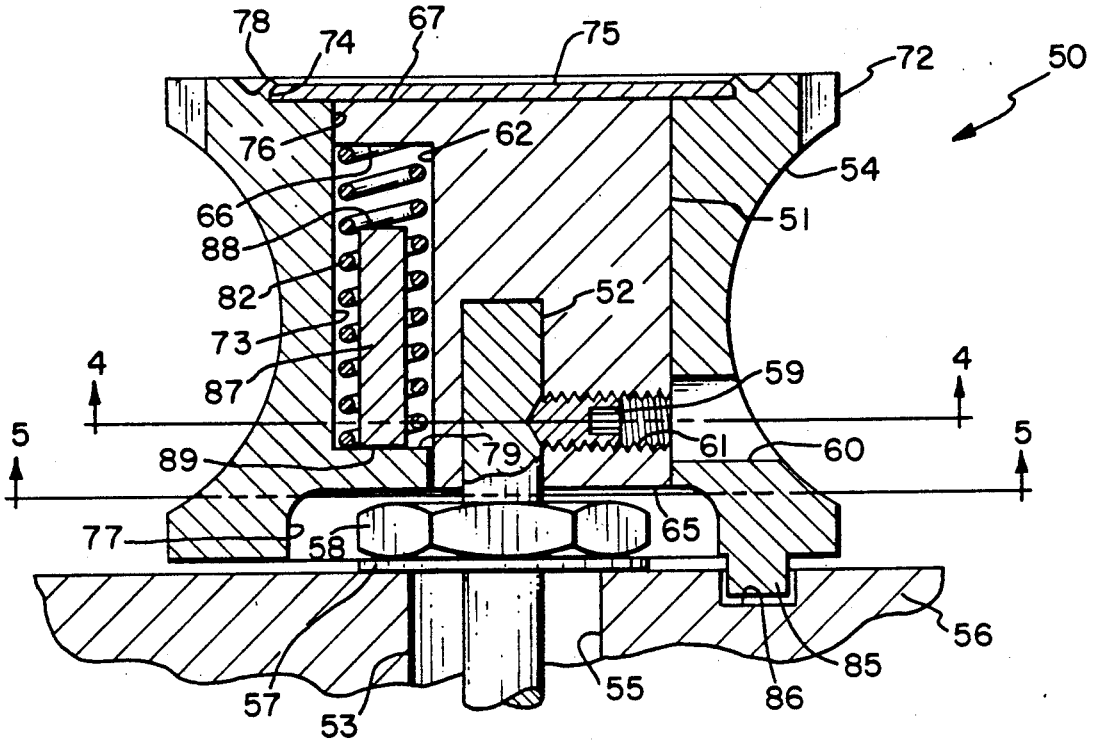
FIG. 3 is a cross sectional view through an ordinance arming switch knob assembly according to a second embodiment of the invention and through a fragmentary portion of a switch and a panel.
Figure 4:
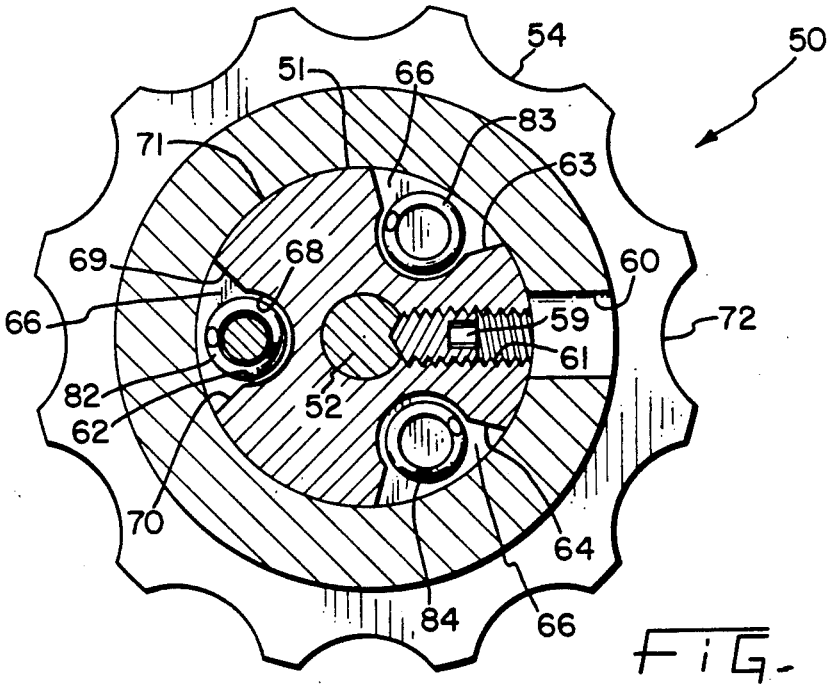
FIG. 4 is a cross sectional view taken along line 4—4 of FIG. 3.
Figure 5:
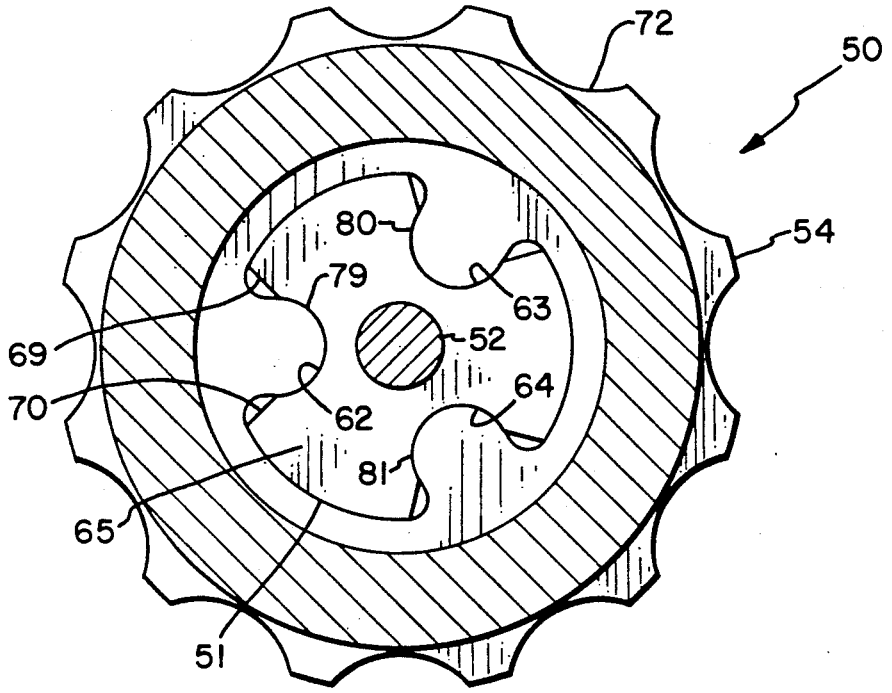
FIG. 5 is a cross sectional view taken along line 5—5 of FIG. 3.

FIGS. 3-5 illustrate a second embodiment according to the invention of a switch knob assembly 50 for arming explosive ordnance (not shown) or for other applications where accidental operation of a switch must be prevented. The assembly 50 includes an arbor 51 secured to a shaft 52 of a rotary switch 53 (shown in fragmentary) and a knob 54. The switch 53 is secured in a keyed opening 55 in a panel 56 with a washer 57 and a nut 58. The arbor 51 is attached to the switch shaft 52 with a cone point setscrew 59 which is passed through an opening 60 in the knob 54 and is threaded into an opening 61 in the arbor 51.

The arbor 51 is generally cylindrical and has three keyways 62-64 formed therein. The three keyways 62-64 each extend parallel to the rotational axis of the switch shaft 52 and to the axis of the arbor 51 and are spaced 120° apart. Each keyway 62-64 is open at an end surface 65 of the arbor 51 adjacent the nut 58 and is closed by an end 66 at an opposite end 67 of the arbor 51. As best seen in FIG. 4, the keyway 62 has a generally semicircular cross sectional area 68 and has flared sides 69 and 70 which join with a cylindrical side 71 of the arbor 51. The keyways 63 and 64 have similar cross sections.

The knob 54 has a knurled or shaped top 72 to facilitate pulling and turning the knob 54. The knob has a central bore 73 which includes an upper end 74 sized to receive a cap 75, an intermediate section 76 and an enlarged lower end 77 which provides clearance for the nut 58. After the arbor 51 is inserted into the bore 73, the cap 75 is secured in the upper bore end 74 by an annular lip 78 on the knob 54 which is bent over the cap 75. Three generally semicircular tabs 79-81 project from the knob 54 radially inwardly into the intermediate bore section 76. The tabs 79-81 are sized to be received by the keyways 62-64, respectively and function as a means for keying knob 54 to arbor 51. The tabs 79-81 slide in the keyways 62-64 when the knob 54 is moved in an axial direction, while preventing rotational motion between the knob 54 and the arbor 51.

A helical compression spring 82 is located in the keyway 62. The axis of the spring 82 is parallel to the axis of the shaft 52 and the spring 82 is compressed between the keyway end 66 on the arbor 51 and the knob tab 79. A second helical compression spring 83 is located in the keyway 63 and is compressed between the keyway end 66 on the arbor 51 and the knob tab 80. Similarly, a third helical compression spring 84 is located in the keyway 64 and is compressed between the keyway end 66 on the arbor 51 and the knob tab 81. The springs 82-84 urge the knob 54 towards the panel 56 until the arbor end 67 abuts the cap 75. When the knob 54 is in this position, as is shown in FIG. 3, a boss 85 integrally formed on the knob 54 projects into a hole 86 in the panel 56. So long as the boss 85 is located in the hole 86, the knob 50 is prevented from being rotated and, hence, the switch 53 cannot be actuated.

As is shown in FIGS. 3 and 4, a pin such as cylinder 87 is located coaxially within the spring 82. When the knob 54 is pulled away from the panel 56 against the pressure of the springs 82-84, the knob 56 can move in an axial direction until an end 88 on the pin 87 abuts the keyway end 66 and an end 89 on the pin 87 abuts the knob tab 79. Further axial motion of the knob 54 is prevented by the pin 87. It should be appreciated that although only one pin 87 is required, a separate pin may be positioned within each of the springs 82-84 and that the one or more pins may be either separate from the knob 54 and the arbor 51, as shown, or may be secured to or integrally formed with either the knob 54 or the arbor 51.

In operation, the springs 82-84 normally position the knob 54 wherein the pin 85 is located in the panel opening 86 so that the switch shaft 52 cannot be accidentally rotated. When the switch 53 must be actuated, the knob 54 first must be pulled against the force of the springs 82-84 until the pin 85 is withdrawn from the stationary panel hole 86 and while continuing to pull, the knob 54 must be rotated to actuate the switch 53. The springs 82-84 exert sufficient force on the knob 54 to prevent accidental operation of the switch 53.

Figure 6:
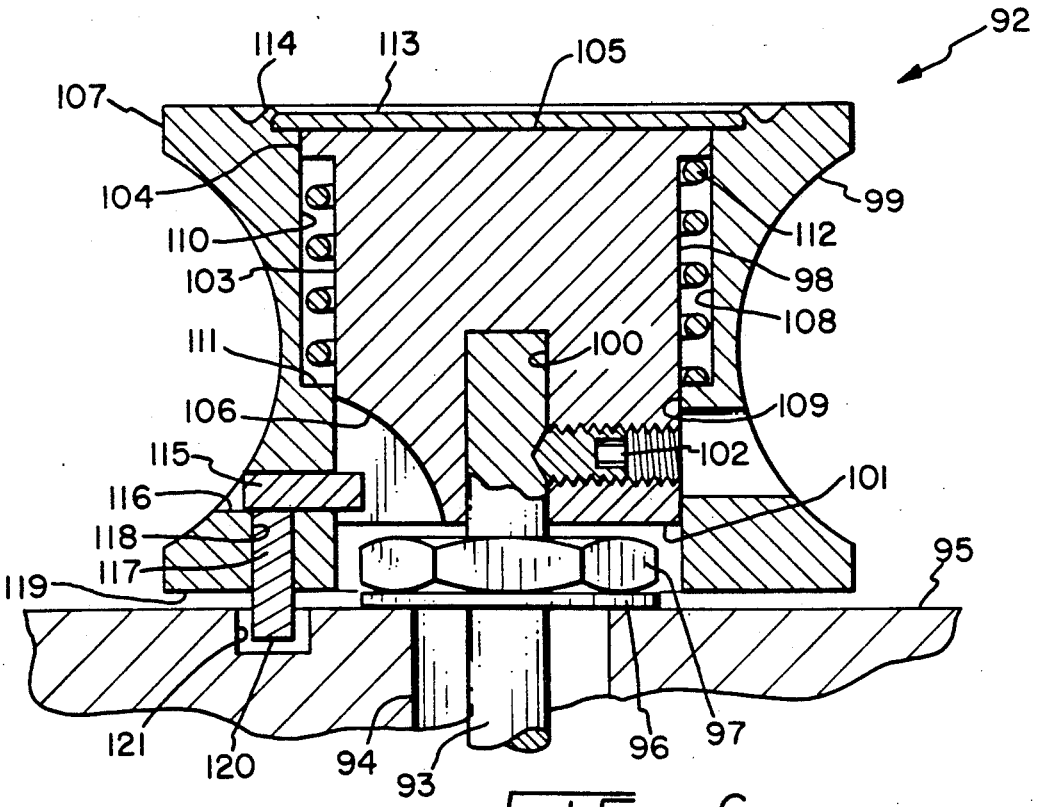
FIG. 6 is a cross sectional view through an ordnance arming switch knob assembly according to a third embodiment of the invention and through a fragmentary portion of a switch and a panel.

FIG. 6 is a cross sectional view of a third embodiment according to the invention of a switch knob assembly 92 for preventing accidental rotation of a shaft 93 on a rotary switch 94 (shown in fragmentary). The switch 94 is shown mounted on a panel 95 with a washer 96 and a nut 97. The assembly 92 includes an arbor 98 and a knob 99 which is keyed for limited axial movement on the arbor 98. The arbor 98 has an axial opening 100 in an end 101 which receives the switch shaft 93. A conical point setscrew 102 secures the arbor 98 to the switch shaft 93. The arbor 98 has a cylindrically shaped surface 103 and has an enlarged diameter flange 104 adjacent an end 105. The arbor 98 further has an arcuate keyway 106 adjacent the end 101.

The knob 99 has a knurled rim 107 to facilitate pulling and rotating the knob 99 to actuate the switch 94. A stepped axial bore 108 extends through the knob 99. The bore 108 has a lower section 109 of a diameter for engaging the arbor surface 103 and an upper section 110 of a diameter for engaging the arbor flange 104. An annular surface 111 is located between the bore sections 109 and 110. A helical compression spring 112 is positioned coaxially around the arbor surface 103 to be compressed between the arbor flange 104 and the annular surface 111. After the arbor 98 and the spring 112 are assembled in the knob bore 108, a cap 113 is positioned in the knob bore 108 and secured by bending an annular lip 114 on the knob 99 over the cap 113. The spring 112 urges the knob 99 relative to the arbor 98 to an axial position wherein the arbor end 105 abuts the cap 113.

A pin 115 is pressed into a radially directed hole 116 in the knob 99 to project from the knob 99 into the keyway 106. The pin 115 restricts the knob 99 to limited axial movement relative to the arbor 98 and rotates the arbor 98 with the knob 99. A second pin 117 is pressed into a hole 118 in a bottom surface 119 of the knob 99. The pin 117 extends in a direction parallel to the axis of the knob 99, the arbor 98 and the shaft 93. The pin 117 has an end 120 which projects from the knob surface 119 and normally extends into a hole 121 in the panel 95.

The switch knob assembly 92 functions similar to the above described switch knob assemblies 10 and 50. Normally, the spring 112 urges the knob 99 to a position relative to the arbor 98 wherein the projecting pin end 120 is located in the stationary hole 121 in the panel 95. This prevents rotation of the knob 99 to actuate the switch 94. In order to actuate the switch 94, the knob 99 must be pulled against the force of the spring 112 until the pin 120 clears the panel hole 121. Once the pin end 120 is held clear of the hole 121, the knob 99 may be rotated to actuate the switch 94.

The three described embodiments of a switch knob assembly each have a pin which engages a hole in a panel mounting a switch. It will be appreciated that the switch knob assembly will function equally well with any stationary hole positioned to be engaged by a projecting knob pin. For example, a positioning hole may be formed in a plate which has a mounting hole that slides over the switch shaft and is clamped between the nut, which secures the switch to a panel, and the panel. The mounting hole in the plate may be keyed, so as not to rotate relative to the switch, or it may be keyed to the panel, so as not to rotate relative to the switch. Although each of the above described knob assemblies has been described as engaging a single stationary hole, it should be noted that the knob assemblies may engage more than one hole. For example, two separate stationary holes may be located with one hole engaged when the rotary switch is in one position and the other hole engaged when the rotary switch is in another position. It will be appreciated that various other modifications and changes may be made to the above described switch knob assemblies without departing from the spirit and the scope of the following claims.

What is claimed is:

1. A knob assembly actuating a rotary switch which is mounted on a stationary base, said switch having a shaft which rotates about an axis extending upwardly from said base for actuation, said knob assembly comprising an arbor, means for securing said arbor to the shaft for rotation with the shaft about the axis, a knob, means for keying said knob to said arbor for limited axial movement relative to said arbor while preventing rotational movement between said knob and said arbor, said knob moving between first and second axial positions relative to said arbor, spring means cooperating with said arbor and said knob for urging said knob from said first position to said second position relative to said arbor, and means for preventing rotation of said knob about the axis when said knob is in said second position and for not interfering with rotation of said knob about the axis when said knob is in said first position, said rotation preventing means including a pin secured to said knob extending in a direction parallel to the axis, said pin engaging a stationary hole in the base when said knob is in said second position and said pin clearing said hole when said knob is in said first position to permit rotation of said knob.

2. A knob assembly, as set forth in claim 1, including a switch mounting panel, and wherein said stationary hole is in said switch mounting panel.

3. A knob assembly actuating a rotary switch which is mounted on a stationary base, said switch having a shaft which rotates about an axis extending upwardly from said base for actuation, said knob assembly comprising an arbor, means for securing said arbor to the shaft for rotation with the shaft about the axis, a knob, means for keying said knob to said arbor for limited axial movement relative to said arbor while preventing rotational movement between said knob and said arbor, said knob moving between first and second axial positions relative to said arbor, spring means cooperating with said arbor and said knob for urging said knob from said first position to said second position relative to said arbor, said spring means comprising a helical compression spring extending around a portion of said arbor, and means for preventing rotation of said knob about the axis when said knob is in said second position and for not interfering with rotation of said knob about the axis when said knob is in said first position, said rotation preventing means including a pin secured to said knob extending in a direction parallel to the axis, said pin engaging a stationary hole in the base when said knob is in said second position and said pin clearing said hole when said knob is in said first position to permit rotation of said knob.

4. A knob assembly, as set forth in claim 3, wherein said compression spring is compressed between an annular surface on said knob and an annular surface on said arbor.

5. A knob assembly, as set forth in claim 3, wherein said compression spring is compressed between an annular surface on said knob and a spring retainer, and means for securing said spring retainer to said arbor.

6. A knob assembly actuating a rotary switch which mounted on a stationary base, said switch having a shaft which rotates about an axis extending upwardly from said base for actuating, said knob assembly comprising an arbor, means for securing said arbor to the shaft for rotation with the shaft about the axis, a knob, means for keying said knob to said arbor for limited axial movement relative to said arbor while preventing rotational movement between said knob and said arbor, said means for keying said knob to said arbor comprising a keyway formed in said arbor to extend in a direction parallel to the axis, said knob having a key extending into said keyway, said knob moving between first and second axial positions relative to said arbor, spring means cooperating with said arbor and said knob comprising a helical compression spring positioned in said keyway to extend in an axial direction between a surface on said arbor and said key for urging said knob from said first position to said second position relative to said arbor, and means for preventing rotation of said knob about the axis when said knob is in said second position and for not interfering with rotation of said knob about the axis when said knob is in said first position, said rotation preventing means including a pin secured to said knob extending in a direction parallel to the axis, said pin engaging a stationary hole in the base when said knob is in said second position and said pin clearing said hole when said knob is in said first position to permit rotation of said means knob.

7. A knob assembly, as set forth in claim 6, and further including a pin positioned coaxially within said compression spring, said pin having a length for abutting said arbor surface and said key when said knob is moved to said first position.

8. A knob assembly, as set forth in claim 6, wherein a plurality of said keyways are formed in said arbor and a plurality of said keys extend from said knob with one key extending into each keyway.

9. A knob assembly, as set forth in claim 8, wherein said separate helical compression spring is positioned in each of said keyways.

10. A knob assembly, as set forth in claim 9, and further including a pin positioned coaxially within one of said compression springs, said pin having a length for abutting said arbor surface and said key when said knob is moved to said first position.

* * * * *